US006558069B1

(12) United States Patent
Flader et al.

(10) Patent No.: US 6,558,069 B1
(45) Date of Patent: May 6, 2003

(54) PAVEMENT MARKER WITH IMPROVED DAYTIME VISIBILITY

(75) Inventors: Michael E. Flader, Chicago; Dennis Couzin, Evanston; Robert M. Pricone, Libertyville, all of IL (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/580,238

(22) Filed: May 26, 2000

Related U.S. Application Data

(60) Provisional application No. 60/136,165, filed on May 27, 1999.

(51) Int. Cl.[7] ..... E01F 9/06; E01F 9/08

(52) U.S. Cl. ..... 404/13; 404/12; 404/14

(58) Field of Search ..... 404/9, 12, 13, 404/14, 16; D10/113; 359/531

(56) References Cited

U.S. PATENT DOCUMENTS

| | | | | | |
|---|---|---|---|---|---|
| 3,332,327 | A | | 7/1967 | Heenan | |
| 3,890,054 | A | * | 6/1975 | O'Connor | 404/10 |
| 4,040,760 | A | | 8/1977 | Wyckoff | |
| 4,303,305 | A | * | 12/1981 | Jones | 350/103 |
| 4,993,868 | A | * | 2/1991 | Eigenmann | 404/12 |
| 5,013,181 | A | | 5/1991 | Harrison | |
| 5,078,538 | A | | 1/1992 | Montalbano | |
| 5,226,745 | A | | 7/1993 | Gartlacher | |
| 5,258,485 | A | | 11/1993 | Matsuo et al. | |
| 5,393,166 | A | | 2/1995 | Stock et al. | |
| 5,403,115 | A | | 4/1995 | Flader | |
| 5,412,381 | A | * | 5/1995 | Dicks | 340/908.1 |
| 5,816,737 | A | | 10/1998 | Siblik | |
| 6,102,612 | A | * | 8/2000 | Pricone et al. | 404/13 |
| 6,126,360 | A | * | 10/2000 | May et al. | 404/14 |

FOREIGN PATENT DOCUMENTS

| | | |
|---|---|---|
| DE | 2361264 | 6/1975 |
| GB | 2139674 | 11/1984 |

* cited by examiner

*Primary Examiner*—Gary S. Hartmann
(74) *Attorney, Agent, or Firm*—Jones, Day

(57) ABSTRACT

A pavement marker having improved daytime visibility comprises a transparent fluorescent top portion having smooth flat parallel top and bottom surfaces with a front edge therebetween and air interfacing most of the bottom surface. Light received by the smooth flat top surface of the top portion is directed internally through the top portion and emitted from the front edge, to provide a visible signal to drivers of oncoming vehicles.

27 Claims, 2 Drawing Sheets

PAVEMENT MARKER WITH IMPROVED DAYTIME VISIBILITY

RELATED APPLICATION

This application claims the benefit of U.S. Provisional Application Ser. No. 60/136,165, filed May 27, 1999.

FIELD OF THE INVENTION

This invention relates to a pavement marker intended to be mounted to a roadway surface and having improved visibility in daytime, as well as providing a visible signal at night.

BACKGROUND OF THE INVENTION

Pavement markers have become widely accepted as means for providing visible signals which mark traffic lanes and control the flow of traffic on roadways in combination with, or in place of, conventional painted traffic lines. A large number of such markers employ retroreflectors which retroreflect light emanating from oncoming vehicles to provide a signal visible to the operators of such oncoming vehicles, especially at night.

Typically, pavement markers comprise a base member designed to be firmly secured to the associated roadway surface; and a retroreflective signal means mounted on or formed as part of the base member. As disclosed in basic U.S. Pat. No. 3,332,327, assigned to the assignee herein, the disclosure of which is incorporated herein by reference, the base member can be a molded plastic housing having cube corner elements. Some pavement markers are intended to be permanently installed on a roadway surface. These include those markers sold by the assignee herein under the model names Stimsonite Model 948, and Stimsonite Model 953. Pavement markers also can be used to delineate roadway construction work zones. Such markers include those sold by the assignee herein under the model name Stimsonite Model 66, intended for temporary installations at construction work zones. The Stimsonite Model 88 sun country marker also can be used for more permanent installations at construction work zones. Pavement markers of the prior art are also disclosed in U.S. Pat. Nos. 5,078,538 and 5,403,115, both assigned to the assignee herein and both being incorporated herein by reference. Other pavement markers of other manufacturers are also available.

In such markers of the prior art, the plastic housing of the pavement marker is typically an opaque color suitable for the intended use of the marker. For example, a marker intended to be placed on or in place of a white dividing lane may be a white plastic, a marker intended to be placed on or in place of a yellow dividing line may be yellow plastic, and a marker intended for temporary placement in a roadway construction work zone may be yellow or white.

While such markers are intended to provide enhanced nighttime visibility by retroreflecting light from vehicle headlights back to the vehicle drivers, it also would be desirable if the markers could provide enhanced daytime visibility. The upper and side surfaces of a raised pavement marker are not readily visible to a driver of an oncoming vehicle, because these surfaces are at an angle highly oblique to the driver's viewing direction. Daytime visibility therefore must be provided primarily by the front surface of the marker, which is easily seen by the driver. The major portion of the marker front surface, however, is occupied by the retroreflector, which for optical reasons appears almost black in daytime. It would be desirable to provide a roadway marker mounted on a roadway surface that provides greater daytime visibility than those markers currently available or described in the prior art. In particular, it would be desirable to provide pavement markers having enhanced daytime visibility and adapted for use in roadway construction work zones.

SUMMARY OF THE INVENTION

In accordance with the invention, a pavement marker comprises a base member having a top portion and a bottom portion, the bottom portion having a bottom surface adapted to be secured to the pavement surface, the top portion having a smooth flat top surface, a smooth flat bottom surface substantially parallel to the top surface and at least one edge surface between said top surface and said bottom surface, the bottom surface of the top portion being secured to the bottom portion of the base member such that there is an air gap between at least part of the top portion and at least part of the bottom portion of the base member, the top portion of the base member being made of a transparent fluorescent resin material. It has been found that light received by the smooth flat top surface of the top portion of the base member is directed internally through the top portion and emitted from the edge surface of the top portion, thereby providing a surprisingly bright daytime signal to drivers of oncoming vehicles. Optionally, the bottom portion of the base member can also be a transparent fluorescent material, or it can be an opaque color of any choice. In a preferred embodiment, the pavement marker will also include a retroreflector mounted on the base member to provide nighttime visibility to drivers of oncoming vehicles. When the inventive marker is to be used in a roadway construction work zone environment, it is preferred that the top flat portion be of a transparent fluorescent orange, such as is commonly used in road signs to denote a construction work zone.

BRIEF DESCRIPTION OF THE DRAWINGS

The present invention will be more fully understood in conjunction with the accompanying drawings.

DETAILED DESCRIPTION OF THE PREFERRED EMBODIMENT

Figure 1:
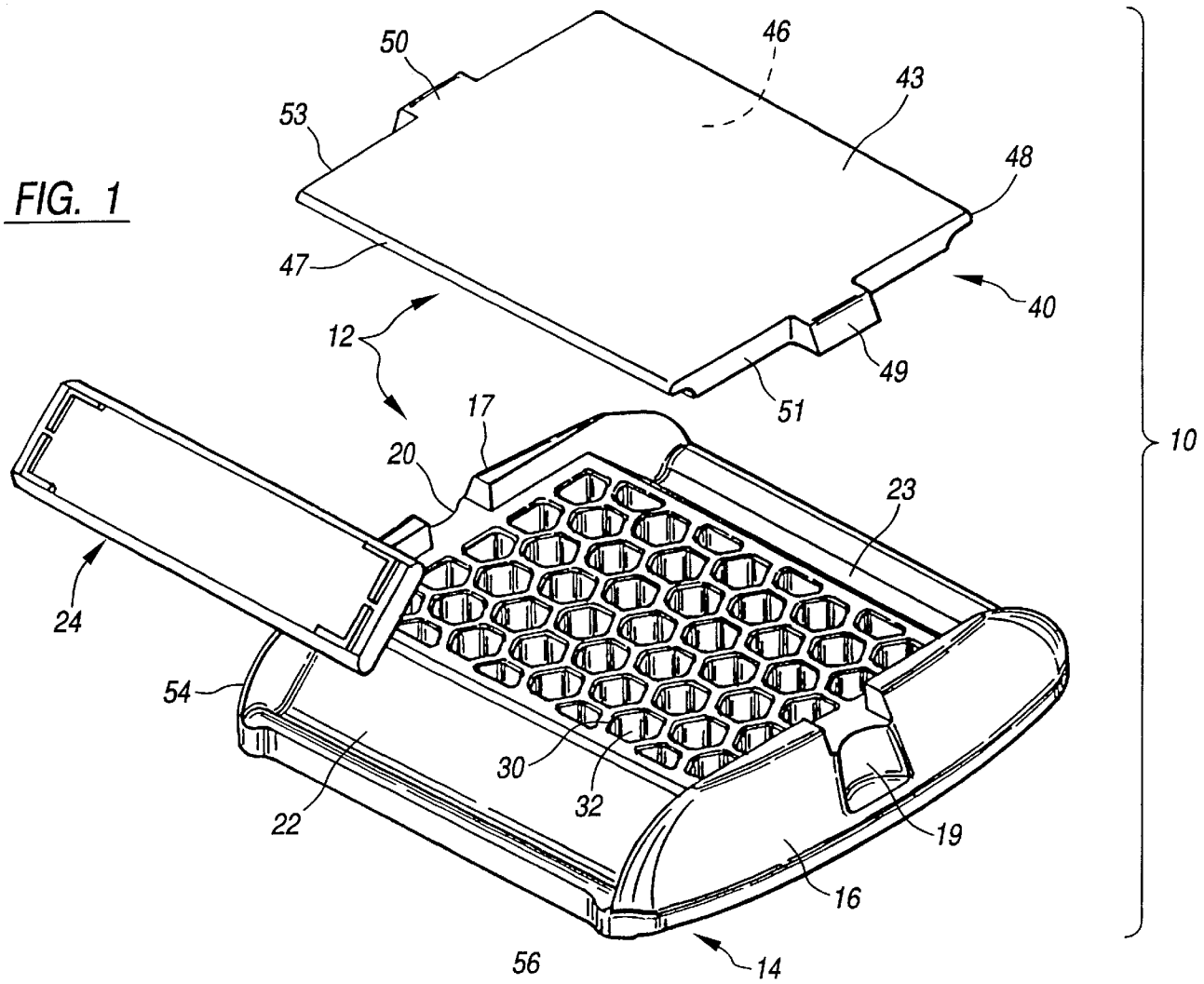
FIG. 1 is an exploded view of an embodiment of the pavement marker of the instant invention.

Referring to FIG. 1, pavement marker 10 comprises a base member 12, the base member comprising a bottom portion 14 and a top portion 40. Bottom portion 14 has longitudinal side walls 16, 17, each of which is provided with optional depression 19, 20. Bottom portion 14 further includes a front surface 22 adapted to receive thereon a signal means 24, such as a cube corner retroreflector (cube corner elements not shown). It will be appreciated that if the marker is to be viewable from vehicles traveling in opposite directions, then there will be another signal means in another surface 23 disposed longitudinally opposite front surface 22. Bottom portion 14 further comprises a top flat surface having a plurality of orifices 32 disposed therein. In the illustrated embodiment the orifices are hexagonal and disposed in a "honeycomb" pattern, although the invention herein is not intended to be limited to the illustrated embodiment. Bottom portion 16 of base member 12 also comprises a bottom surface, not shown, adapted to be adhered to a roadway surface, such as by means of an appropriate adhesive.

Top portion 40 of base member 12 comprises a smooth flat top surface 43, a smooth flat bottom surface 46 substantially parallel to said top surface 43, and a front edge surface 47 disposed between said top surface 43 and said bottom surface 46. Optional transversely projecting tabs 49, 50 are sized and positioned on top portion 40 to extend over depressions 19, 20 when the bottom portion 14 and top portion 40 are assembled together. Top portion 40 is made of a transparent fluorescent resin material.

Top portion 40 is assembled to bottom portion 14 by a means such as welding, the welding being in a predetermined location or pattern so as to provide an air gap between as much of bottom surface 46 of top portion 40 and top surface 30 of bottom portion 14 as possible, while still retaining top portion 40 securely on bottom portion 14; tack welds or line welds can be adequate for this purpose. It will be seen that the orifices 32 provide the surface area of bottom surface 46 that will be in contact with air.

In such a configuration, the top portion 40 exhibits the phenomenon known as "edge glow." Light entering smooth flat top surface 43 of transparent top portion 40 containing fluorescent colorants excites fluorescent emission within the volume of the top portion 40. As understood in the optical arts, for the boundary separating two optical media, "critical angle" is defined as the smallest angle of incidence in the medium of greater refractive index for which light is totally reflected, or, alternatively, the greatest angle of incidence for which light escapes the medium. Fluorescent emission is spherical. Within the sphere is a double cone of rays that meet flat surfaces 43 and 46 of transparent top portion 40 at incidence angles less than the critical angle $\theta_c$. The fraction of the spherical volume outside this double cone is cos $\theta_c$, representing the fraction of the fluorescence which total internal reflection (TIR) prevents from escaping from surfaces 43 and 46 of top portion 40. TIR is the ideal dielectric face reflectivity that can occur at the interface between a transparent material and air, whereby light traveling within the material and encountering the interface is internally reflected and so remains in the material.

The fraction of emitted light outside the double cone which experiences TIR is cos $\theta_c$, which for a particular material can be determined as $$\cos\theta_c = \frac{\sqrt{n^2 - 1}}{n}$$

where n is the index of refraction of the material. For example, acrylic has an index of refraction of 1.49, its critical angle is calculated as $\theta_c$=42.16°, and cos $\theta_c$=0.74. In other words, for a top portion 40 made of an acrylic material, 74% of the emitted fluorescent light will experience TIR at the solid/air interfaces at smooth flat surfaces 43 and 46, and will be returned from those interfaces back into top portion 40.

Since top portion 40 has smooth and parallel top and bottom flat surfaces 43 and 46, the fluorescent light will continue to reflect and re-reflect by TIR until it reaches an edge surface; i.e., when configured as a flat plate with smooth parallel faces, top portion 40 functions as a light pipe to direct fluorescent emissions induced within the volume of top portion 40 by light incident on top surface 43 thereof toward the edge surfaces, including edge surface 47. Assuming that edge surface 47 is substantially perpendicular to smooth flat surfaces 43, 46, the angle of incidence of light at the edge will be less than 90−$\theta_c$ for most of the previously trapped light. As the surface area of top surface 43 is increased, more light will be received, more fluorescent emissions will be induced, and more light will be directed to the edge surfaces, including edge surface 47. Light emitted through edge surface 47 provides a brighter daytime signal to the driver of an oncoming vehicle as compared to opaque pavement markers of the prior art.

Edge surface 47 can be vertical, or it can be inclined at an angle of up to about ±60° with respect to the vertical. The configuration of edge surface 47, including its angle of tilt with respect to the vertical, can be chosen to maximize the amount of light emitted from edge surface 47 that will be directed back to the driver of an oncoming vehicle. This useful light will be in the angular range of about −3° (down) to about +5° (up). The selection of the angle to maximize the emission of useful light from the edge can depend on factors such as the number and placement of welds between the top portion 40 and the bottom portion 14, and on the color of the bottom portion. Bottom portion 14 can be the same transparent fluorescent orange as top portion 40, or bottom portion 14 can be opaque, such as opaque orange or opaque white. It is believed that opaque bottom portion 14 can be advantageous because a certain percentage of light that passes through top portion 40 will not be reflected by TIR at bottom surface 46, but will pass through bottom surface 46, such as at the weld points where there is no air interface. It is believed that if bottom portion 14 is opaque, a significant amount of this light will be reflected back into top portion 40, and thus have a chance to be "piped" out to edge surface 47. It is currently believed that an embodiment with a fluorescent orange top portion 40, an opaque white bottom portion 14, and an edge surface 47 tilted downward at an angle of about 30° with respect to the vertical might provide a greater amount of useful light emitted through edge surface 47, i.e., a greater amount of light emitted within the approximately −3° to +5° angle so as to be visible to the driver of an oncoming vehicle, than an embodiment having the edge surface 47 vertical.

It is expected that a white opaque bottom portion 14 will provide the additional advantage of reflecting blue and green light and possibly ultraviolet light which passes through the top portion 40 back into top portion 40 for a second chance to excite fluorescence therein.

In those embodiments of the instant invention in which bottom portion 14 is transparent fluorescent orange, longitudinal side walls 16 and 17 also can function as light-piping devices with front-edge glow, in the same manner as top portion 40. This can be done by establishing air interfaces within bottom portion 14 that are approximately parallel to and equidistant from the outer surfaces of longitudinal side walls 16, 17. Daylight striking the outer surfaces of longitudinal side walls 16, 17 can be light-piped to forward facing surfaces 54, 56 of longitudinal side walls 16, 17 disposed laterally adjacent to signal means 24, and will be emitted therefrom to increase the daytime visibility of marker 10. For example, in the illustrated embodiment, but preferably without optional depressions 19, 20, longitudinal side walls 16, 17 can collect in total approximately ⅓ as much daylight as top portion 40, resulting in an increase in total front-edge glow of marker 10 of about ⅓. The amount of light collected by longitudinal side walls 16, 17 and emitted as front-edge glow at surfaces 54, 56 can be optimized, such as by modifications to the configurations of longitudinal side walls 16, 17, and front surfaces 54, 56.

The pavement marker of the instant invention can be made as a one-way marker, in which the marker is intended to provide useful light in only one direction, such as for use on one-way roads; or the marker can be made as a two-way marker, in which the marker is intended to provide useful light in two opposite directions, such as for use on roadways that have two-way traffic. If pavement marker 10 is intended as a two-way marker, then edge surface 48 disposed longitudinally opposite edge surface 47 can be configured to be symmetrical to edge surface 47, assuming that it is desired that the marker have the same illuminating properties in both directions. If the marker 10 is intended as a one-way marker, then edge surface 48 need not have any light-emitting properties. In that case, edge surface 48 can be configured as a saw-tooth edge with a 90° included angle between adjoining faces. This will cause the most useful portion of light that would otherwise be emitted through edge surface 48 to reflect by TIR back toward edge surface 47, thus increasing the brightness of the marker to drivers of oncoming vehicles. Lateral edge surfaces 51 and 53 also can be provided with modified saw-tooth configurations, whether the marker is a one-way marker or a two-way marker, so that light that would otherwise be lost through these lateral edge surfaces can be redirected back into the volume of top portion 40, where it can be subsequently emitted through edge surface 47 as useful light visible to drivers of oncoming vehicles. Metallization of sawtooth edges is also possible.

In some embodiments of the invention, it may be desirable to bond a thin layer of glass or apply an abrasion resistant finish on top surface 43 of top portion 40, to minimize scuffing or abrasion of the top surface 43 that would reduce the TIR that allows the bright signal of the instant invention.

Top portion 40 can serve as a light pipe not only for light incident on top surface 43, but also for light emanating from within the marker, such as from a light emitting diode (LED). Thus an LED situated within the body of bottom portion 14 can be coupled to top portion 40 such that light is directed for emergence either through edge surface 47 or through both edge surfaces 47 and 48, depending on the intended functionality of the marker device.

EXAMPLE

Pavement markers as shown in FIG. 1 were formed of an acrylic resin containing 2% by weight of type ORC-24347-A orange fluorescent colorant available from the Clariant, Masterbatches Division, of McHenry, Ill., with the top portion welded to the bottom portion. The top portion measured about 8.0 cm in the transverse direction, about 6.4 cm in the longitudinal direction, and about 0.35 cm thick. The regular hexagonal weld pattern between the top portion and the bottom portion occupied about 40% of the bottom surface of the top portion. When placed on a roadway surface under moderate winter daylight and spaced at about 60 feet apart, the markers provided good lane guidance to a distance of at least about 300 feet. Unlike nighttime retroreflection, the daytime luminous intensity of the markers did not change with distance. The apparent intensity decreased as a square of the distance from the marker, but the angular closeness of the markers also decreased as a square of the distance from one marker to the next. Thus a very long line of the markers was visible.

Figure 2:
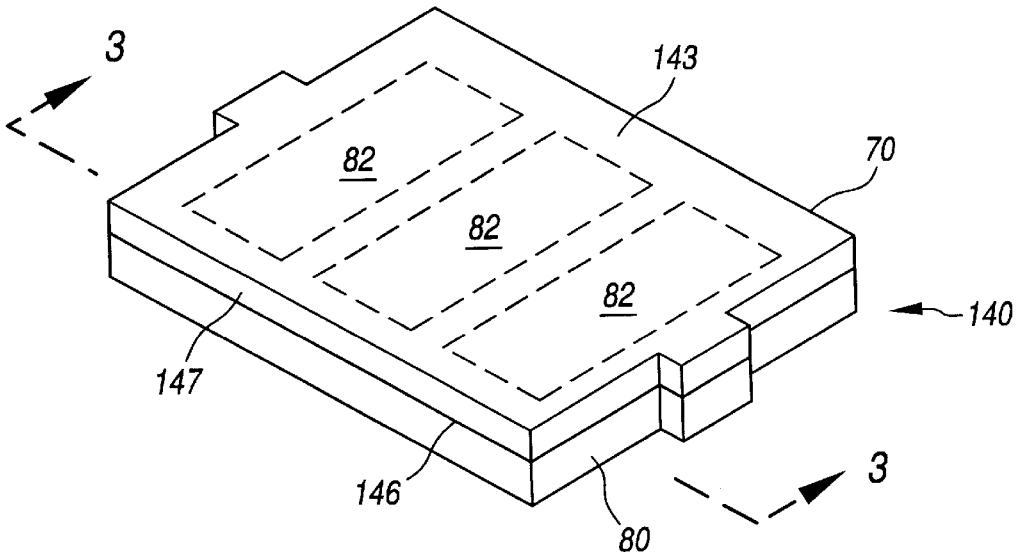
FIG. 2 is a perspective view of a top portion of an alternative embodiment of the instant invention.
Figure 3:
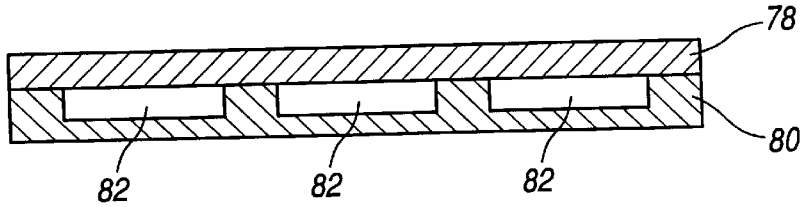
FIG. 3 is a cross-section view along line 3—3 of FIG. 2.

In an alternative embodiment of the instant invention illustrated in FIGS. 2, 3, top portion 140 can be constructed as a two-layer structure with a top light-transmissible fluorescent layer 70 and a bottom layer 80 which can be either transparent fluorescent or opaque. Top layer 70 has a front edge surface 147 at a predetermined angle with respect to the roadway surface, and substantially smooth top surface 143 and bottom surface 146. Top layer 70 and bottom layer 80 are so structured and dimensioned so as to have a plurality of air gaps therebetween when assembled together. For example, bottom layer 80 may have a plurality of grooves or channels 82, shown in phantom lines in FIG. 2 and solid lines in FIG. 3, extending along most of the length thereof and only partially through the depth thereof. Top layer 70 and bottom layer 80 can be assembled together by welding or other known means to form top portion 140. Top portion 140 can then be affixed by epoxy or other known means to a corresponding bottom portion that can carry a retroreflective element, to form a finished roadway marker with improved daytime visibility. In such a construction, the two-layer top portion 140 will serve as a light pipe to direct light incident on top surface 143 to exit top layer 70 through front edge surface 147. As described above, the size edge surfaces of top layer 70 can be provided with saw-tooth edges and/or metallized to facilitate the re-direction of incident light through front edge surface 147.

The pavement marker of the instant invention has been described as being fluorescent orange, which is the color indicative of construction work zones in the United States. Other fluorescent colors can also be used with the inventive pavement markers. For example, fluorescent yellow-green can be used to delineate school zones, or construction zones in other countries. Fluorescent pink or fuschia markers can be used to delineate special traffic lanes, such as electronic pass lanes at toll booths on toll highways.

What has been described herein is at present what is believed to be the preferred embodiment of the invention, but it is understood that various modifications may be made to the preferred embodiment without departing from the scope of the invention described herein.

What is claimed is:

1. A pavement marker for providing a signal on an associated roadway surface visible to a driver of an oncoming vehicle, said pavement marker comprising a base member, said base member comprising a bottom portion adapted to be mounted to the associated roadway surface, and a top portion adapted to be mounted on top of the bottom portion, said top and bottom portions being configured so as to establish an air gap therebetween when said top portion is mounted on said bottom portion, said top portion having a front edge surface, said top portion comprising a light-transmissible fluorescent resin material, whereby light received by said top portion is directed through said top portion and emitted through said front edge surface to provide a signal visible to a driver of an oncoming vehicle.

2. The pavement marker of claim 1 wherein said bottom portion is configured with a plurality of orifices adjacent the top portion to establish an air gap between said top and bottom portions.

3. The pavement marker of claim 1 wherein said top portion is mounted to said bottom portion by means of welding.

4. The pavement marker of claim 1 wherein said top portion has smooth opposing top and bottom surfaces.

5. The pavement marker of claim 1 further including a retroreflective element.

6. The pavement marker of claim 1 wherein said bottom portion comprises a light-transmissible fluorescent resin material.

7. The pavement marker of claim 6 wherein said bottom portion comprises forward facing surfaces through which is emitted light received by said bottom portion.

8. The pavement marker of claim 1 wherein said top portion comprises an acrylic material.

9. The pavement marker of claim 1 wherein said front edge surface of said top portion is substantially vertical.

10. The pavement marker of claim 1 wherein said front edge surface of said top portion is tilted at a predetermined angle.

11. The pavement marker of claim 10 where said front edge surface of said top portion is tilted downward at an angle of about 30°.

12. The pavement marker of claim 1 wherein said bottom portion comprises an opaque material.

13. The pavement marker of claim 12 wherein said bottom portion comprises an opaque white material.

14. The pavement marker of claim 1 wherein said top portion further comprises a rear edge surface disposed longitudinally opposite said front edge, such that a portion of the light received by said top portion is directed through said top portion and emitted through said rear edge surface to provide a signal to a driver of a vehicle approaching the marker from the rear direction.

15. The pavement marker of claim 1 wherein said top portion further comprises a rear edge surface disposed longitudinally opposite said front edge, said rear edge being configured to redirect light toward said front edge surface to be emitted therethrough.

16. The pavement marker of claim 15, wherein said rear edge surface being configured to redirect light toward said front edge surface to be emitted therethrough as a saw-tooth edge surface with substantially 90° included angle between adjoining faces.

17. The pavement marker of claim 16 wherein said rear edge surface of said top portion is metallized.

18. The pavement marker of claim 1 wherein said top portion further comprises one or more side edge surfaces extending between said front edge surface and a rear edge surface, said one or more side edge surfaces being configured to redirect light to the interior of said top portion.

19. The pavement marker of claim 18 wherein said one or more side edge surfaces is configured as a saw-tooth edge surface with substantially 90° included angle between adjoining faces.

20. The pavement marker of claim 19 wherein said one or more side edge surfaces is metallized.

21. The pavement marker of claim 1 wherein said top portion has a top surface provided with an abrasion resistant finish.

22. The pavement marker of claim 1 wherein said top portion has a top surface provided with a glass layer.

23. The pavement marker of claim 1 further comprising an LED disposed in said bottom portion and coupled to said top portion such that light from said LED is emitted through said front edge surface.

24. The pavement marker of claim 1 wherein said bottom portion is provided with depressions on either side thereof and said top portion extends over said depressions, to provide a structure for facilitating holding of said pavement marker.

25. A pavement marker for providing a signal on an associated roadway surface visible to a driver of an oncoming vehicle, said marker comprising a base member, said base member comprising a structure of a light-transmissible fluorescent resin material, said structure having a top surface and a front edge surface, said base member being configured to provide an air gap between said base member and said structure of light-transmissible fluorescent material, whereby light received by said top surface is directed through said structure and emitted through said front edge surface to provide a signal to a driver of an oncoming vehicle.

26. A pavement marker for providing a signal on an associated roadway surface visible to a driver of an oncoming vehicle, said pavement marker comprising a base member, said base member comprising a bottom portion adapted to be mounted on the roadway surface, and a top portion adapted to be mounted on said bottom portion, said top portion comprising a top layer of a light-transmissible fluorescent resin material and a bottom layer, said top layer having a light-receiving surface and a front edge surface, said top portion being so constructed so as to provide an air gap between said top layer and said bottom layer, whereby light received by said top surface is directed through said top layer and emitted through said front edge surface to provide a signal to a driver of an oncoming vehicle.

27. The pavement marker of claim 26 wherein said bottom portion is provided with depressions on either side thereof and said top portion extends over said depressions, to provide a structure for facilitating holding of said pavement marker.

* * * * *